United States Patent [19]

Schultze et al.

[11] Patent Number: 4,995,194

[45] Date of Patent: Feb. 26, 1991

[54] POWER-ASSIST DOOR CLOSER

[75] Inventors: Eckart F. Schultze; Richard Easter; Robert V. Funderburk, all of Charlotte, N.C.

[73] Assignee: Yale Security Inc., Monroe, N.C.

[21] Appl. No.: 500,023

[22] Filed: Mar. 27, 1990

[51] Int. Cl.[5] ..... E05F 15/10

[52] U.S. Cl. ..... 49/32; 49/334; 49/340; 16/58

[58] Field of Search ..... 49/32, 334, 340; 16/58

[56] References Cited

U.S. PATENT DOCUMENTS

| | | | |
|---|---|---|---|
| 2,549,451 | 4/1951 | Gossling | 49/32 |
| 2,639,142 | 5/1953 | Morgan et al. | 49/340 |
| 2,800,323 | 7/1957 | West et al. | 49/32 |
| 2,910,290 | 10/1959 | Buchanan | 49/32 X |
| 3,874,117 | 4/1975 | Boehm | 49/340 X |
| 3,936,977 | 2/1976 | Runft et al. | 49/340 X |
| 3,948,000 | 4/1976 | Pedersen | 49/340 |
| 4,429,490 | 2/1984 | Zunkel | 49/32 |
| 4,793,023 | 12/1988 | Simpson et al. | 16/58 |

*Primary Examiner*—Philip C. Kannan
*Assistant Examiner*—Jerry Redman
*Attorney, Agent, or Firm*—Dallett Hoopes

[57] ABSTRACT

An hydraulic door closer has a motor/pump component to assist opening the door by supplying oil under pressure to the closer cylinder. The component is activated by a switch sensitive to the turning of the closer pinion shaft as the door is moved out of its frame. Further, the distance which the door must move until the switch activates the motor/pump component is adjustable. The hydraulic circuitry is conveniently embodied in a single manifold block.

14 Claims, 5 Drawing Sheets

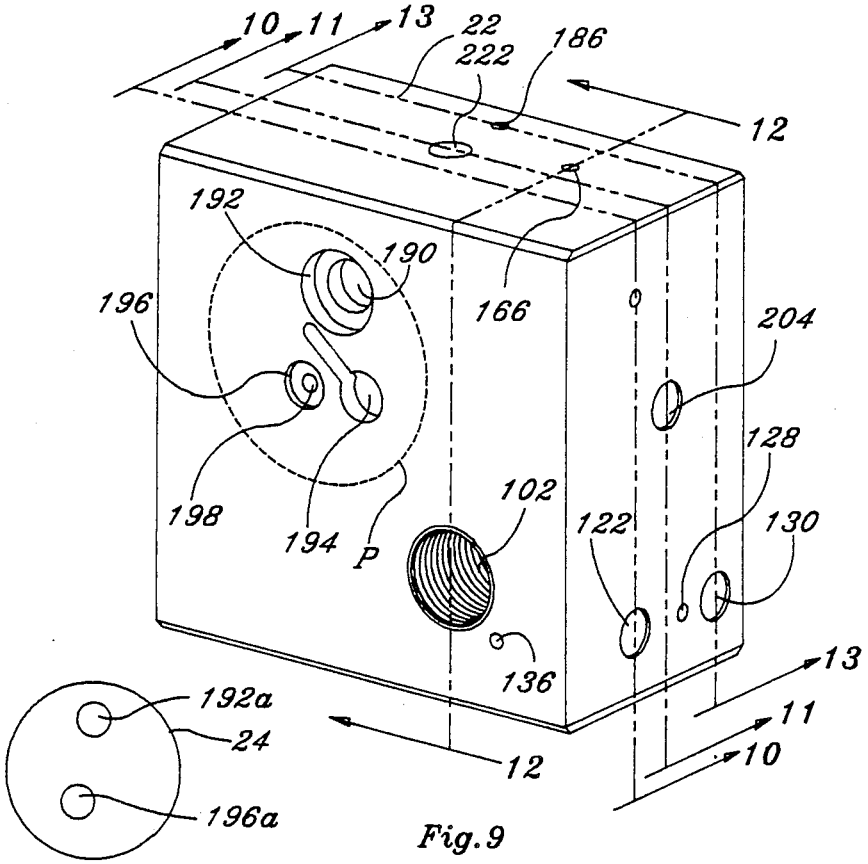
Fig. 9
Fig. 9a
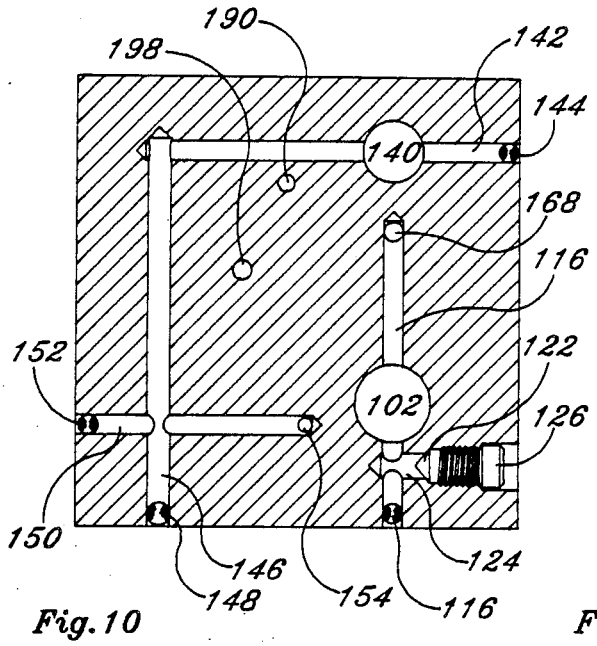
Fig. 10
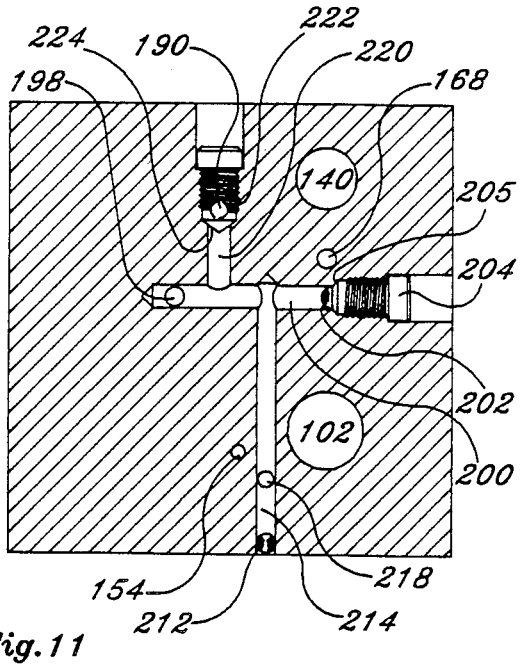
Fig. 11

POWER-ASSIST DOOR CLOSER

BACKGROUND OF THE INVENTION

1. Field of the Invention

This invention relates to a door closer which has power means to assist the opening of the door and is especially adapted for use in areas frequented by the elderly and infirm. The door closer of the invention is hydraulic and the means for power assist are also hydraulic.

2. Description of Related Art Including Information Disclosed under §§1.97 to 1.99

There are in the prior art a number of showings of power assist door openers. Usually the power assist is the pneumatic type which, therefore, require the availability of air under pressure. Examples are: U.S. Pat. No. 4,040,144 to Lasier et al, issued Aug. 9, 1977; U.S. Pat. No. 4,429,490 to Richard Zunkel, issued Feb. 7, 1944; and U.S. Pat No. 4,010,572 to Francis C. Peterson, issued Mar. 8, 1977.

Other power assist door openers are: U.S. Pat. No(s). 3,087,720; 3,762,099; 3,470,653; 4,222,147; and 4,339,843.

Lacking in the power assist closers shown in the prior art are adjustable means to activate the power assist feature responsive to the distance which the door is moved out of the frame by the person opening the door. The prior art does include the aforementioned Zunkel patent which discloses a door opener which is activated as the door is moved out of its frame. However, there are no adequate means to adjust the required magnitude of the "bump".

Further, the prior art does not disclose a compact self-contained hydraulic power assist door closer.

SUMMARY OF THE INVENTION

The invention herein is a power assist door closer having means to adjust the required movement of the door out of the frame to activate the power assist feature. Further, the present invention provides a door closer notable for its compactness and self-contained hydraulic power means.

The present assignee is the assignee of an earlier U.S. Pat. No. 4,793,023 which issued Dec. 27, 1988 to Simpson et al. In this patent there are disclosed means for independently controlling the sweep and the latch speed of the closing door. There is further disclosed solenoid means for closing off the flow of hydraulic fluid from the pressure side of the closer so that the door may be held open in a given position. The present invention includes similar elements but also includes power assist means. These means are all disposed within a single manifold mounted adjacent the power end of the cylinder.

BRIEF DESCRIPTION OF THE DRAWINGS

Other objects and features of the invention will be understood from the following specification and drawings all of which disclose a non-limiting embodiment of the invention. In the drawings:

FIG. 9 is a perspective view showing a manifold block embodying the invention; it is shown in position comparable to FIG. 3 with the wall of the block which in assembly is against the plate 12 is directed down in FIG. 9;

FIG. 9*a* is a simplified, reduced view of the end of the pump showing connections which mate with the openings shown in the manifold;

FIG. 10 is a sectional view taken on the line 10—10 of FIG. 9;

FIG. 11 is a sectional view taken on the line 11—11 of FIG. 9;

DESCRIPTION OF THE PERFERRED EMBODIMENT

Figures 1, 2, 3:
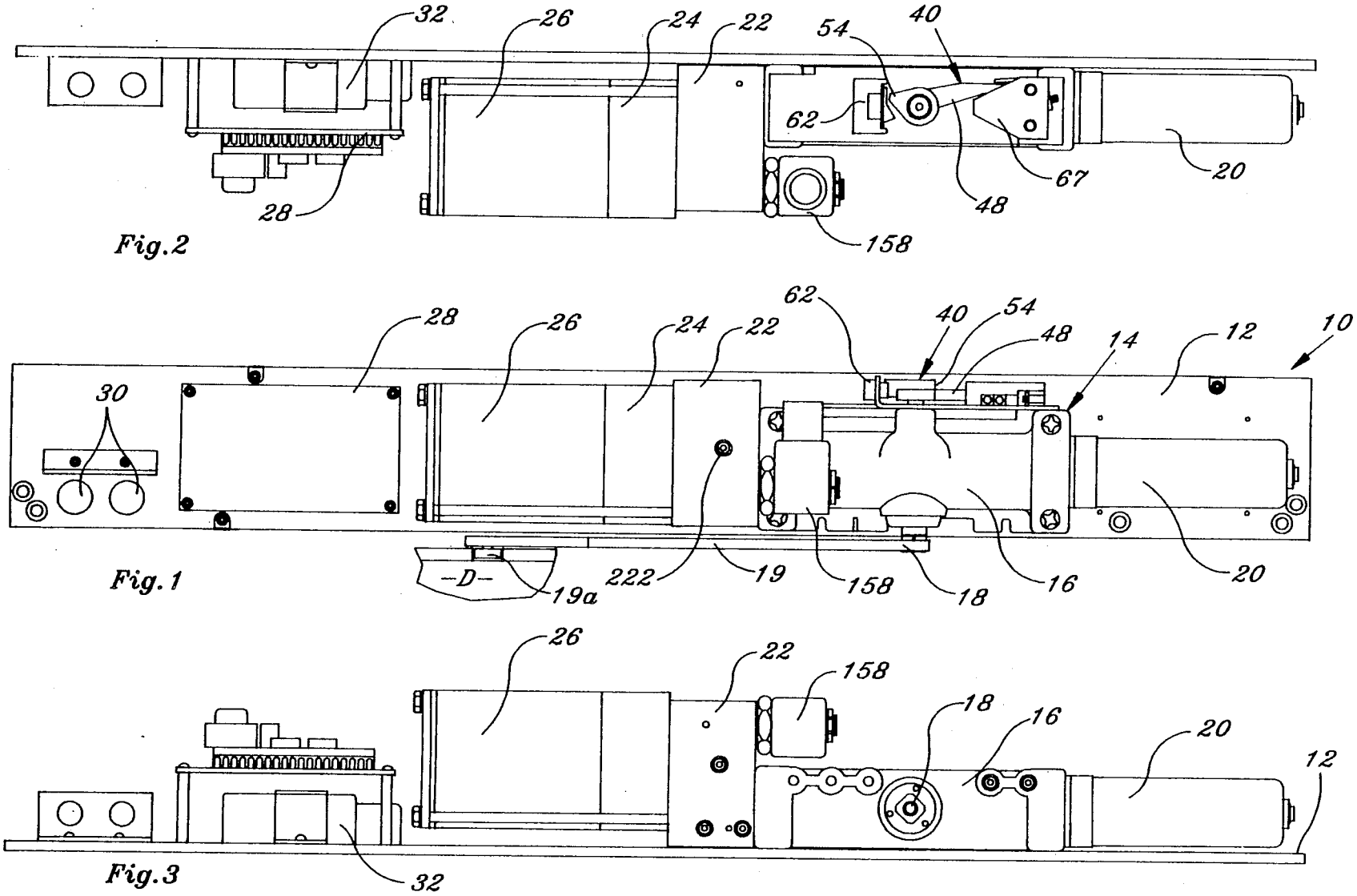
FIG. 1 is a front view of a door closer assembly emobodying the invention.
FIG. 2 is a top plan view.
FIG. 3 is a bottom plan view.

A preferred form of a door closer embodying the invention is shown in FIG. 1 and generally designated 10. It comprises a base plate 12 which may be attached against a door frame immediately above the door opening.

Secured to the plate 12 is a closer 14 which comprises a conventional door closer cylinder 16 having a conventional drive shaft 18. To the shaft is attached an operator arm 19 having a roller 19*a* which rides on a track in a door D (FIG. 1) as is conventional. (See U.S. Pat. No. 4,876,764 issued Oct. 31, 1989 to our assignee.)

To the rightward end of the closer is attached a spring housing 20 and to the leftward side is attached a manifold block 22. To the leftward side of the block 22 is the pump unit 24 driven by the electric motor 26. Appropriate electric circuitry is mounted on the board 28 and power supply wires may come into the unit through openings 30 in the base plate. A condenser 32 (FIG. 3) is connected to the motor 26 for reasons well known in the art.

Here, as disclosed in the above-mentioned Simpson et al patent, the cylinder 16 contains a piston provided with a rack which meshes with a pinion disposed on shaft 18 within the cylinder 16. As is conventional, a spring which may be partly housed in the housing 20, urges the piston leftwardly in the door-closing direction. In the more ordinary door closer arrangements the piston is driven to the right by the person opening the door.

In installation, not shown, an operating arm either of the single piece, or articulated variety has one end fixed on the lower end of the pinion shaft 18 and the other fastened to the door.

PUMP ACTUATING SWITCH

The pump 24 which, as will be explained, pressurizes the opening side of the piston to assist in the opening, is driven by motor 26. The power to the pump motor is controlled by the switch unit which is generally designated 40 and shown in FIGS. 1 and 2 and 4 through 7.

Figure 8:
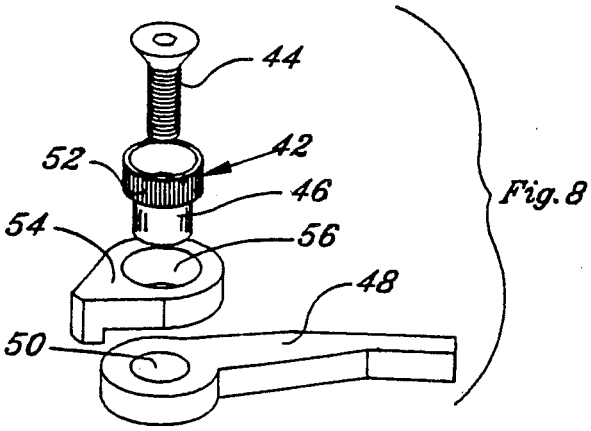
FIG. 8 is an enlarged exploded view of the switch actuators shown in FIGS. 4 through 7.

The upper end of the closer drive shaft 18 is provided with a bushing 42 (FIG. 8). The bushing is rigidly secured onto the shaft 18 by a bolt 44 which is screwed into a tapped opening in the upper end of the shaft. The bushing 24 thus turns with the pinion shaft 18. As shown in FIG. 8, the section 46 of the bushing 42 is smooth and reduced. Frictionally engaging about this section is the nylon switch-operating arm 48 which receives the section 46 into its opening 50.

The upper section 52 of the bushing 42 is knurled. A tear drop-shaped, rocker switch finger 54 is provided and its opening 56 receives the knurled section 52 so that the finger 54 is keyed to turn with the pinion shaft 18.

Secured to the cylinder 16 is a switch mounting plate 60. This mounts a rocker switch 62 which faces the finger 54 and is positioned so that the rocker switch will be actuated by the finger as the shaft 18 moves through its cycle. Also mounted on the plate 60 is a microswitch 64 disposed on its side at a relatively great distance from the shaft 18 as compared with switch 62. Switch 64 has an actuator button 66. A triangular guard 67 having three legs covers the switch.

On the opposite side of the switch 64 from the shaft 18 a section of the plate 60 is struck up as at 68 and bifurcated. Thereadjacent is also an upward pin 70. A generally L-shaped stop member 72 is centrally apertured to pivotally receive the pin 70. One leg 74 of the stop member 72 constitutes an abutment surface and is disposed opposite the actuator button 66. The other leg 76 is drilled and threaded and receives the threaded element 78 which is reduced adjacent its inner end as at 80 to be loosely embraced by the bifurcated end of the upstruck element 68.

Figure 6:
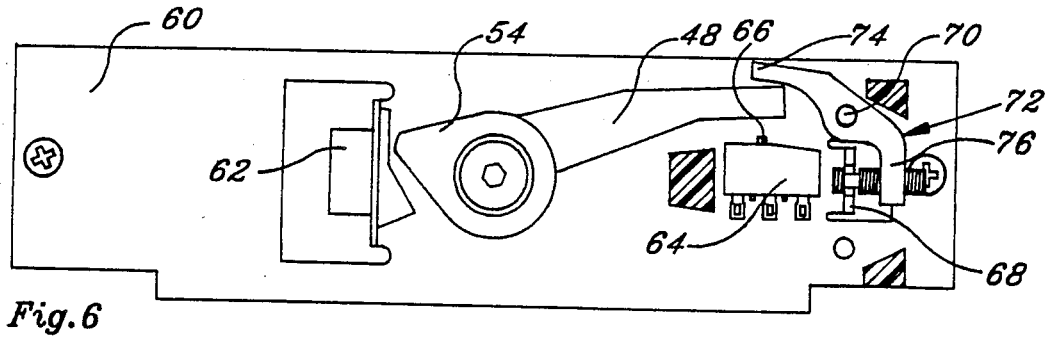
FIG. 6 is a view showing the switch arm as it would appear as the door is closing.
Figure 7:
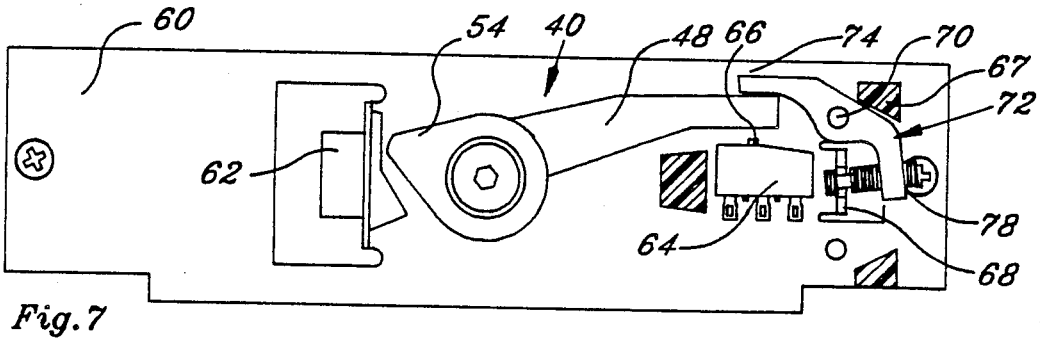
FIG. 7 is a top plan view similar to FIGS. 4 and 6 but showing the stop means for the switch closed down to a short distance so that on subsequent opening of the door the pump is activated as the door is moved out of its frame by a lesser distance than in FIG. 6.
Figure 5:
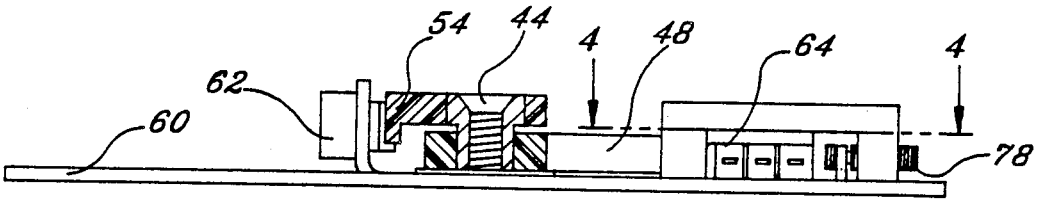
FIG. 5 is a front elevational view partly in section as at line 5—5 of FIG. 4.

As a result, when the threaded element 78 is screwed in or out, the stop member 72 pivots as shown in FIG. 6 vs. FIG. 7 to control the distance between the actuator button 66 and the abutment surface 74 defining the travel of the arm 48.

Figure 4:
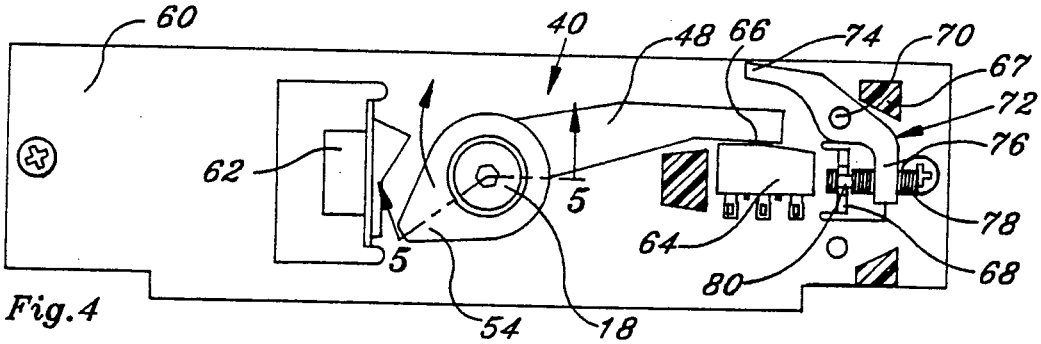
FIG. 4 is a greatly enlarged top plan view partly in section of switching assembly as shown in FIG. 2 and in accordance with the section line 4—4 shown in FIG. 5 and showing the parts as the power assist is engaged.

Putting this above-described arrangement into perspective, it will be seen that when the door starts to open and the shaft 18 rotates clockwise (in the direction of the arrow in FIG. 4), the arm 48 moves downward as shown in FIG. 4 to press the actuator button 66. This activates the motor/pump unit 24, 26 so that there is hydraulic assistance in the opening of the door as will be explained. After the arm engages the button 66, it slips on bushing 42 (section 46) as the shaft continues to rotate.

When the door closes, the shaft 18 will rotate counterclockwise causing the shaft 48 to disengage the button 66 (FIG. 6) and swing to engage the abutment surface 74 on the stop 72. The shaft 18 continues to rotate toward the door close position, the arm 48 slipping on the bushing section 46.

Subsequently, when the door is opened, depending on the position of the stop 72 (FIG. 6 vs. FIG. 7) the door will have to be moved out of its frame (i.e. bumped toward an ajar position) a greater or lesser distance for the arm 48 to move from abutment surface 74 to meet and depress the button 66. In other words, what the above-described unit accomplishes therefore, is an adjustable exact control of the amount of distance the door has to be moved out of its frame before the motor pump unit 24, 26 is activated.

The throwing of the rocker switch 62 by the finger 54 is accomplished to control the deactivation of the motor pump unit. This is done as the shaft 18 rotates clockwise, between the FIG. 4 and FIG. 6 positions. In the FIG. 6 position the door has just completed its opening process and the rocker switch 62 has been thrown by the finger 54. The door has now started to close as evidenced by the arm 48 being raised off the actuator button 66. Subsequently, as the shaft 18 continues counterclockwise, the finger 54 will throw the switch 62 again to ready the assembly for another door-opening phase. Such a phase will only begin, however, when the door is pushed away from its frame in an opening direction (a clockwise movement of shaft 18).

The electric circuitry which is to be used in embodiments of the invention is not disclosed herein. Such circuitry should be derivable by those skilled in the art at least to the extent necessary to operate this structure thus far disclosed.

HYDRAULIC CIRCUITRY AND MANIFOLD ARRANGEMENT

As indicated, the hydraulic circuitry for operating the cylinder is for the most part embodied in the manifold block 22. Outwardly this block is a rectangular solid. On its rightward side it is formed with cylindrical boss 90 (FIGS. 12, 14) as in Simpson et al. Adjacent its outer end the boss has a peripheral recess receiving an O-ring 92. As shown in FIG. 2, the boss 92 fits snugly inside the end of the cylinder 16 in sealing relation. Further, there is a gasket 94 disposed between the end of the cylinder 16 and the rightward face of the manifold block 22.

Figure 12:
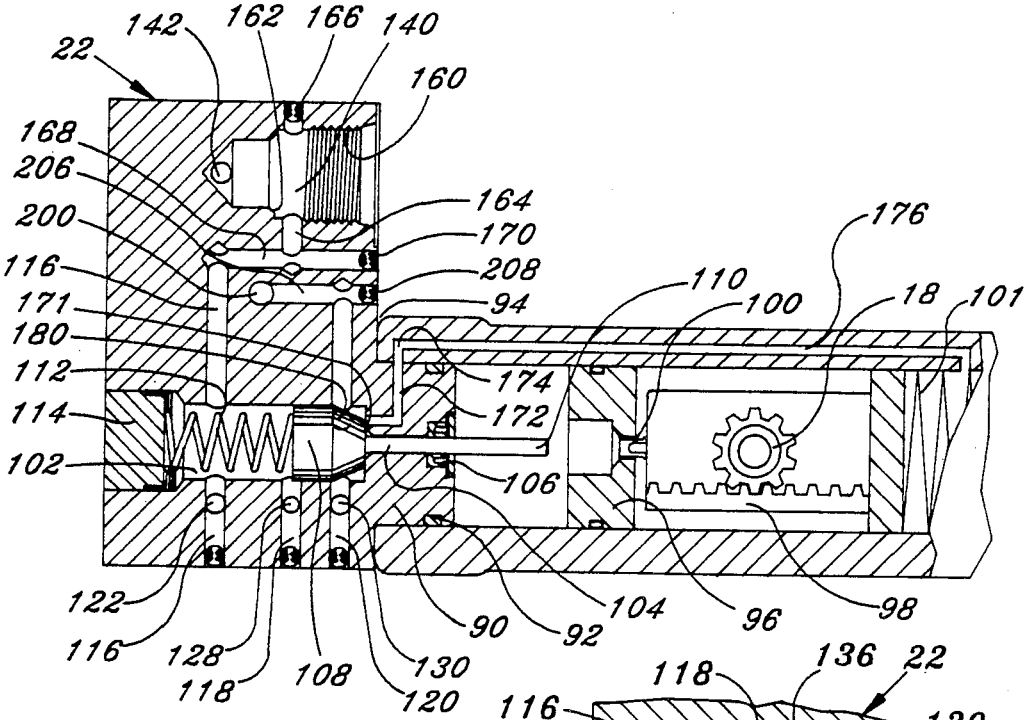
FIG. 12 is a sectional view taken on the line 12—12 of FIG. 9 and showing in addition and partly in section a fragment of cylinder secured to the block.

As shown in FIG. 12, there is disposed operatively within the cylinder 16 a journal or piston 96. As is conventional, the piston is provided with a central recess formed with a rack 98 which is engaged by the pinion mounted centrally on the shaft 18. The piston is provided with a conventional check valve 100 which permits oil within the cylinder to pass easily through the opening around the check valve 100 as the piston 96 is moved to the right in manual opening of the door. Movement of the piston to the right is opposed by the closer spring 101 enclosed in the housing 20.

From its leftward face (FIG. 12) the manifold block 22 is bored out to present a speed control or plunger chamber 102. At the rightward end of the chamber there is drilled a hole 104 which is surrounded at its rightward end by a seal 106.

As described in the above-mentioned Simpson et al patent, a plunger 108 is inserted into the chamber 102, the plunger stem 110 extending through the hole 104 and protruding into the chamber defined by the cylinder 16. A spring 112 is provided and is received into a recess in the body of the plunger 108. A plug 114 is screwed into the enlarged and threaded leftward end of the chamber 102 to close the chamber.

Three separate paralled passages 116, 118, 120 are drilled from the back of the manifold block into the plunger chamber 102. These passages as shown are plugged adjacent the back surface of the manifold. The passage 116 is provided with an intersecting valve passage 122 (FIG. 10) which is enlarged to provide a seat 124 on which a threaded latch control valve 126 may be made to engage. The passage 122 is enlarged and threaded as shown in FIG. 10 to receive valve 126.

Figure 15:
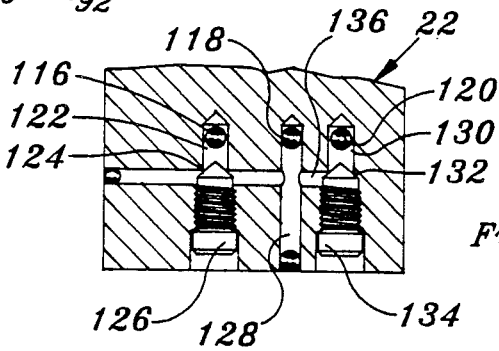
FIG. 15 is a fragmentary sectional view taken on the line 15—15 of FIG. 13.
Figure 13:
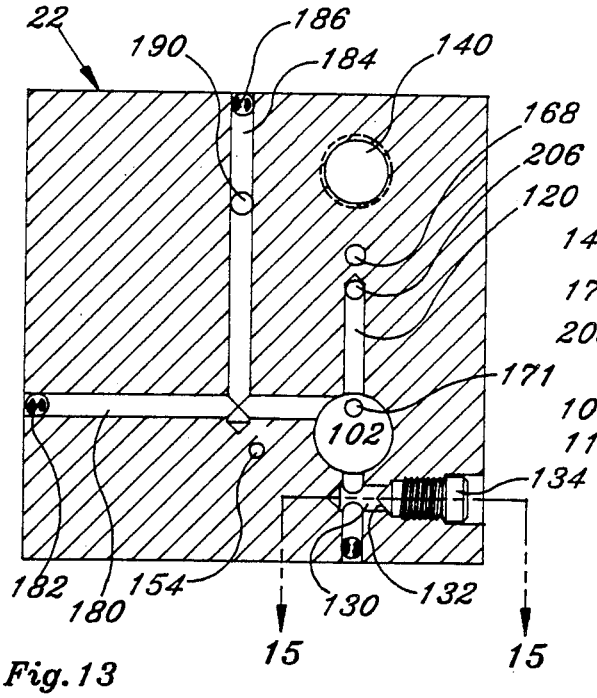
FIG. 13 is a sectional view taken on the line 13—13 of FIG. 9.

Passage 118 is intercepted by a perpendicular passage 128 which is plugged adjacent the bottom face of the manifold (FIG. 9). Passage 120 is also provided with a perpendicular passage 130 which is enlarged to provide a seat 132 and the enlargement is threaded to receive a sweep control valve 134. An intersecting bore 136 (FIG. 15) connects the enlargements of the passages 130, 122 and 128.

Figure 14:
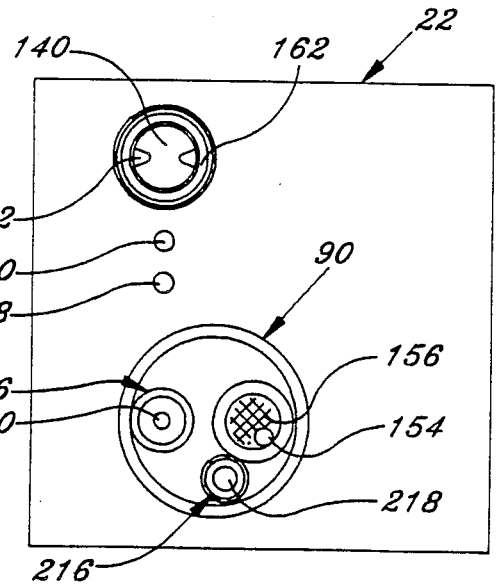
FIG. 14 is a view of the rightward face of the manifold block shown in FIG. 3.
Figure 16:
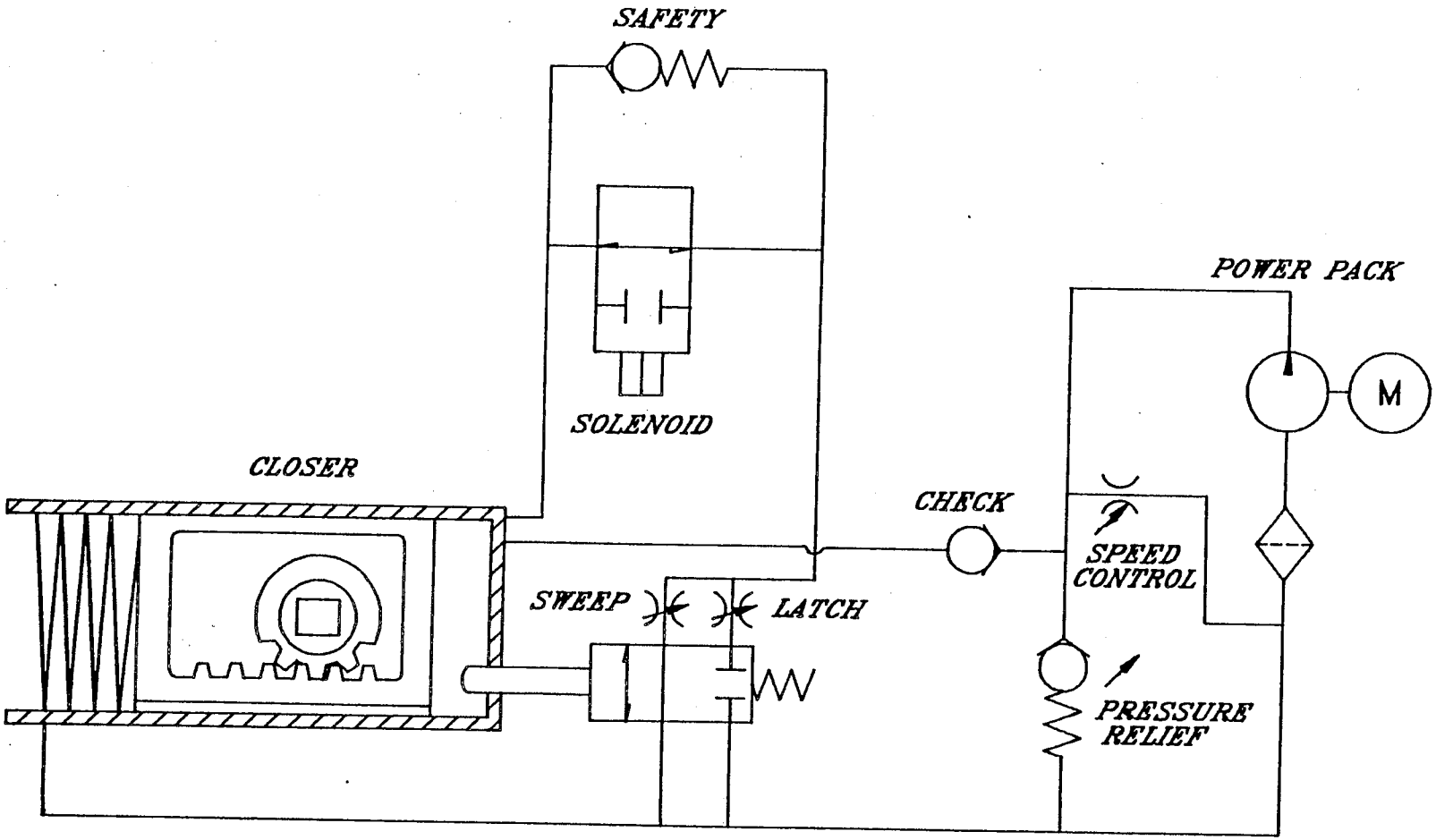
FIG. 16 is a schematic view of the hydraulic flow circuit of a closer embodying the invention.

A solenoid valve seat and chamber 140 is bored into the block 22 from the rightward base, as shown in FIGS. 12, 14. Preferably it is aligned with the plunger chamber 102. To show more the drawings, FIGS. 9, 10, 11, 13 are oriented so that the bottom face of the manifold, normally facing down above the door when it is installed, is on the right hand side of the Figs.

From the bottom face of the manifold block a passage 142 (FIG. 10) is drilled through the inward end of the chamber 140 and beyond as shown, and that drilling is plugged 144 adjacent the bottom surface of the block. Intercepting the passage 142 a passage 146 is drilled from the back of the block and plugged at 148. From the top of the block (left in FIG. 10) another intersecting passage 150 is drilled and plugged at 152.

From the outer face of the boss 90 (FIG. 14), a passage 154 is drilled, the boss end of the passage 154 being covered with a filter 156 to screen debris from inside the cylinder. Passage 154 meets passage 150 (FIG. 10).

A solenoid 158 (FIGS. 1 through 3) is screwed into the threaded portion 160 of the chamber 140. The solenoid, not shown in FIG. 12, has a valve element which sits on the seat 162 of the chamber 140 when the valve is closed.

On the opposite side of the seat 162 (FIG. 12) from passage 142 a passage 164 is drilled and plugged as at 166. A passage 168, intersecting passage 164, is drilled from the rightward face and plugged as at 170. This also intercepts an extension of the earlier described passage 116 which joins chamber 102 toward its leftward end.

From the rightward end of the chamber 102 (FIG. 12) a passage 17 is drilled and an intersecting passage 172 is drilled radially in the boss 90. Passage 172 aligns with a passage 174, 176 in the shell of the cylinder 16 to the far end of the cylinder past piston 96 through a port (not shown).

Thus far the hydraulic circuitry for the return flow of fluid as the door is closing has been described. In operation, with the door open and the spring 101 (FIG. 12) pushing the piston 96 leftwardly, hydraulic fluid passes through the screen 156 (FIG. 14) passage 154 (FIG. 10) passage 150, 146, 142 and into the solenoid chamber 140. Assuming the solenoid valve is open, the fluid then flows into passage 164 (FIG. 12) 168, 116 and into the plunger chamber 102. If the solenoid valve is closed, there is no circulation of oil and the door is held open.

With the plunger 108 in the FIG. 12 position fluid exits the chamber 102 through the passage 118, common passage 136, sweep valve 132, 134, passage 130 and out boss passage 172 and shell passages 174 and 176 and through the chamber on the far side of the piston 96.

When the door closes far enough so that the piston 96 engages the stem 110, the plunger 108 moves leftwardly to block flow of return fluid through passage 128. Return is then made through passage 116, passage 122, latch valve 124, 126 further through the common passage 136, passage 130, 120 and then through passage 172 and cylinder shell passages 174, 176 to the outlet port (not shown).

By this means the valve 132, 134 controls the speed of the closing door during the sweep cycle and valve 126, 124 controls the speed of the closing door through the latch portion, all as described in Simpson et al.

POWER-ASSIST CIRCUITRY

A passage 180 is drilled from the top of the manifold block (to the left in FIG. 13) and plugged as at 182. It intercepts the plunger chamber 102 adjacent the rightward end thereof (FIG. 12). From the front wall of the manifold block an intersecting passage 184 is drilled and plugged as at 186. From the leftward face an intersecting passage 190 is drilled (FIG. 9) and enlarged on the leftward face to present an intake port 192. The intake port 192 is connected to the inlet port **192*a* of the pump 24 (FIG. 9*a***).

The pump 24, which may be a conventional hydraulic gear-type pump, is bolted onto the manifold block in an outline P shown in dotted lines in FIG. 9. Under the port 192 the leftward face is formed with a keyhole-shaped opening 194 adapted to align between the gears of the pump and to provide for seal leakage.

From the leftward face (FIG. 9) a pressure port 196 is formed and a passage 198 is drilled in the center of it into the block. The pressure port 196 is connected to the pressure port **196*a* of the pump 24 (FIG. 9*a*). From the bottom wall (to the right in FIG. 11) a passage 200 is drilled intercepting passage 198, and a relief valve comprising a spring-pressed ball 202 backed by a threaded valve element 204 which is screwed into a threaded enlargement in passage 200. The ball 202 sits on seat 205** until excess pressure drives the ball off the seat.

Intercepting the seat 205 (FIG. 11) is passage 206 which is plugged as at 208. Passage 206 is intercepted by passage 120 an extension of the earlier-described passage. Passage 120 enters the rightward end of the plunger chamber 102 as shown in FIG. 12. From the back wall (bottom in FIG. 11) of the manifold block a passage 214 is drilled and plugged as at 212 and intercepts the passage 200. From the end of the boss 90 (FIG. 14) a pressure port 216 into the cylinder is formed and a passage 218 is drilled from there which intercepts the passage 214 (FIG. 11).

From the front face of the manifold block (top in FIG. 11) a passage 220 is drilled to intercept passage 200. Outwardly it is enlarged and threaded to receive a speed control valve 222 provided with a seat 224. Above the seat 224 the passage 220 is intercepted by an extension of passage 190, the inlet passage to the pump.

The pressure passage has now been detailed. The sequence of operation is that when the pump is activated, oil is drawn from the far side of the cylinder through passages 176 and 174, boss passage 172 and into the right side of the plunger chamber. From there it is drawn through passage 180, (FIG. 13) 184, 190 and in through the port 192 into the pumping chamber. From the perssure side of the pump oil under pressure is pumped through passage 198, passage 200 (FIG. 11), 214 and 218 out into the chamber at the leftward side of the piston 96.

It will be clear that adjustment of the valve 222, 224 will permit to a greater or lesser degree the circular flow of oil from the pump discharge 198 through passage 200, passage 220, valve 222, 224 and out to the pump intake 190. This adjustment has been designed to afford a convenient and ready control of the speed of door opening. As can be seen, the valve 222 is on the front of the manifold in easy access (FIG. 1).

As a pressure relief, the valve 202, 204 is provided. Should too great a pressure build up in the pump discharge line 198, 200, 214, 218, etc. the spring pressed valve 202 (FIG. 11) will give way rising from its seat and permit oil to escape through passages 206, 120 and down into the rightward end of the plunger chamber. Thus, if someone tries to force the door closed or hold the door while it is being opened, the build-up of pressure will activate the pressure relief 202, 204.

OVERALL OPERATION

It is believed that the operation of the power-assisted door closer thus far described should now by clear to those skilled in the art. The various functions of the valves and passages of the manifold block 22 have heretofore been described.

The overall operation commences when someone starts to open the door, the shaft 18 will be turned in a clockwise direction in FIG. 2 (for the hand of the door and closer herein described). This will cause the arm 48 to activate the switch 64 which will activate the pump 24 to cause pressure fluid to enter through port 216 into the chamber to the lefthand side of piston 96. This will drive the piston 96 rightwardly to assist in the opening of the door, or, depending upon the setting of valve 222, will open the door with virtually no assistance of any person. When the door has reached its open position, the switch 62 will be turned off by the finger 54 to deactivate the pump 24. The electrical circuitry and operation has not been disclosed herein because it can be developed by one skilled in the art given the general purpose and desired operation of the closer.

In closing, the door closer oil moves inward through filter 156 and passage 154, through the solenoid 140, 158 and into the plunger chamber 102 through passage 116. With the sweep and latch valves controlling the speed of the returning piston, as described above, oil exits the plunger chamber through the passages 171, 172 and 174, 176 to the far end of the cylinder.

An advantage of the structure disclosed is that in the event of power failure or the like the closer of the invention operates as a conventional non-power-assist closer.

FIG. 17 discloses schematically the hydraulic arrangement heretofore disclosed.

It will be clear that there has been developed and disclosed herein a power-assisted door closer of unusually compact and effective construction and which affords various adjustments of its functions to an extent not heretofore known in the art.

While the present disclosure does disclose a single embodiment, it should be clear that the invention is not limited to the embodiment disclosed by the application, but is capable of variations and modifications. The invention, therefore, may be defined in accordance with the following claim language or equivalents thereof.

What is claimed is:

1. An hydraulic power-assist door closer comprising (a) a cylinder having a pinion mounted therein with an external drive shaft operatively connected to the door, (b) a piston operatively disposed in the cylinder and formed with a rack engaging the piston, (c) a manifold block secured against the cylinder and having a boss sealingly disposed in an end of the cylinder, (d) check valve means in the piston adapted to close as the piston moves toward the said end and open when the door is opened manually, (e) spring means in the cylinder urging the piston in the direction of the block, (f) a pump mounted against the opposite side of the block from the cylinder and having an inlet port and a pressure outlet port disposed flat against the manifold, (g) means to drive the pump, (h) door-opening pressure passage means in the manifold conducting oil from the pressure outlet port through the boss and into the said end of the cylinder, (i) a plunger chamber in the manifold adjacent the boss, (j) door-opening return passage means in the cylinder and manifold conducting oil from the cylinder at a point on the opposite side of the piston from the boss, through the boss and into the plunger chamber adjacent the boss and out the chamber adjacent the boss and into the inlet port of the pump.

2. An hydraulic power-assist door closer as claimed in claim 1 wherein a bleed passage means is provided in the manifold block whereby the door-opening return pressure passage means and the passage means are connected in the manifold block.

3. An hydraulic power-assist door closer as claimed in claim 2 wherein a speed control valve is disposed in the manifold block in the bleed passage means.

4. An hydraulic power-assist door closer as claimed in claim 1 wherein a pressure relief passage means is provided in the manifold connected between the door-opening pressure passage means and the plunger chamber at the end adjacent the boss.

5. An hydraulic power-assist door closer as claimed in claim 1 further including, (1) a plunger in the plunger chamber and having a shaft extending through a sealed bore in the manifold boss and into the interior of the cylinder to be engaged and depressed by the piston near the end of its travel toward the manifold end, biasing means urging the plunger toward the cylinder, (2) latch passage means interconnecting longitudinally spaced first and second openings in the wall of the plunger chamber, the first opening being more remote from the cylinder than the second opening, both openings being outward of the plunger when the plunger is in a first position close to the cylinder, and on opposite sides of the plunger when the plunger is moved by the piston to a second position away from the cylinder, (3) sweep passage means interconnecting the second opening and a third opening in the speed control chamber at a point on the opposite side of the plunger from the other two openings when the plunger is in the first position, and (4) door-closing passage means in the cylinder and manifold conducting oil from the cylinder adjacent the boss to the remote end of the plunger chamber from the boss and from the end of the plunger chamber adjacent the boss to the cylinder on the opposite side of the piston from the boss.

6. An hydraulic power-assist door closer as claimed in claim 5 wherein a sweep control valve is disposed in the sweep passage means and a latch control valve is disposed in the latch passage means.

7. An hydraulic power-assist door closer as claimed in claim 5 further including a solenoid-operated hold-open valve in the manifold block and disposed in the door-closing passage means between the end of the cylinder adjacent the manifold and the remote end of the plunger chamber from the boss.

8. An hydraulic power-assist door closer as claimed in claim 5 wherein the door-closing passage means coincide with portions of the door-opening return passage means.

9. An hydraulic power-assist door closer as claimed in claim 1 further including (a) a switch operator arm frictionally mounted on an end of the drive shaft so that the distal end of the switch operator arm shuttles between two closely spaced points as the door opens and closes, the switch operator arm slipping on the shaft after it arrives at a point and the shaft continues to turn, (b) an electric switch at one of the points which the arm contacts and actuates to start the pump means as the door is moved out of its frame, (c) stop means at the other point, one of said stop means and switch means being adjustably positioned toward and away from the other point.

10. An hydraulic power-assist door closer comprising (a) a cylinder having a pinion mounted therein with a drive shaft having external ends on either side of the cylinder, (b) a piston in the cylinder having a rack meshing with the pinion, (c) spring means in the cylinder for driving the piston in a door-closing direction, (d) electrically driven hydraulic pump means connected to the cylinder for driving the piston in the door-opening direction, (e) a door operator arm having an end rigidly connected to one end of the drive shaft so that the door is operatively connected to the pinion, (f) a switch operator arm frictionally mounted on the other end of the drive shaft so that its outer end shuttles between two closely spaced points as the door opens and closes, the switch operator arm slipping on the shaft after it arrives at one of the points and the shaft continues to turn, (g) an electric switch at said one point which the arm contacts and actuates to start the pump means as the door is moved out of its frame, (h) stop means at the other point, one of said stop means and switch means being adjustably positioned toward and away from the other point.

11. An hydraulic power-assist door closer as claimed in claim 10 wherein the stop means is adjustable.

12. An hydraulic power-assist door closer as claimed in claim 11 wherein the stop means comprises an L-shaped element pivoted at its apex with one leg at said one point and threaded means on the other leg pivots the L-shaped element.

13. An hydraulic power-assist door closer as claimed in claim 10 wherein a second switch is provided adjacent the shaft and a finger is fixedly secured to the said other end of the drive shaft to engage the second switch to control the shutting down of the pump after the door is open.

14. An hydraulic power-assist door closer comprising (a) a cylinder having a pinion mounted therein with an external drive shaft operatively connected to the door, (b) a piston operatively disposed in the cylinder and formed with a rack engaging the piston, (c) a manifold block secured against the cylinder and having a boss sealingly disposed in an end of the cylinder, (d) check valve means in the piston adapted to close as the piston moves toward the said end and open when the door is opened manually, (e) spring means in the cylinder urging the piston in the direction of the block, (f) a pump mounted against the opposite side of the block from the cylinder and having an inlet port and a pressure outlet port disposed against the manifold, (g) means to drive the pump, (h) door-opening pressure passage means in the manifold conducting oil from the pressure outlet port through the boss and into the said end of the cylinder, (i) door-opening return passage means in the cylinder and manifold conducting oil from the cylinder at a point on the opposite side of the piston from the boss, through the boss and into the inlet port of the pump.

* * * * *